US006965354B2

(12) United States Patent
Pendry

(10) Patent No.: US 6,965,354 B2
(45) Date of Patent: Nov. 15, 2005

(54) NARROW BEAM ANTENNA

(75) Inventor: John Brian Pendry, Surrey (GB)

(73) Assignee: Imperial College Innovations Limited, London (GB)

( * ) Notice: Subject to any disclaimer, the term of this patent is extended or adjusted under 35 U.S.C. 154(b) by 89 days.

(21) Appl. No.: 10/706,586

(22) Filed: Nov. 12, 2003

(65) Prior Publication Data

US 2005/0099348 A1 May 12, 2005

(51) Int. Cl.[7] ..... H01Q 15/02
(52) U.S. Cl. ..... 343/909; 343/753; 333/99 S
(58) Field of Search ..... 343/753, 754, 343/909, 911 L, 911 R; 333/99 R, 99 S, 219; 342/22, 25, 27

(56) References Cited

U.S. PATENT DOCUMENTS

| | | | | |
|---|---|---|---|---|
| 2,795,783 A | * | 6/1957 | Dunbar | 343/754 |
| 6,621,448 B1 | * | 9/2003 | Lasky et al. | 342/22 |
| 6,788,273 B1 | * | 9/2004 | Schultz et al. | 343/909 |
| 6,791,432 B2 | * | 9/2004 | Smith et al. | 333/99 S |

OTHER PUBLICATIONS

Bessel Functions—Orders 3–9, Bessel Functions of Integer Order, Compiled from British Association for the Advancement of Science, Bessel functions, Part II. Functions of positive integer order, Mathematical Tables, vol. X (Cambridge Univ. Press, Cambridge, England, 1952) and Mathematical Tables Project, Table of fn(s)=n!(1/2X)–$^{n}J_{n}$(x). J. Math. Phys. 23, 45–60 (1944) (with permission).

Woodward, P.M., and Lawson, J.D., "The Theoretical Precision with Which an Arbitrary Radiation–Pattern may be Obtained from a Source of Finite Size." Journal I.E.E., vol. 95, Part III, No. 37, Sep. 1948.

Veselago, V.G., The Electrodynamics of Substances with Simultaneously Negative Values of $\epsilon$ and $\mu$, Soviet Physics USPEKHI, vol. 10, No. 4, Jan.–Feb. 1968.

Pendry, J.B., Holden<A.J., Stewart, W.J., and Youngs, I., "Extremely Low Frequency Plasmons in Metallic Microstructures." Phys. Rev. Lett. 76, 4773–6, (1996).

Pendry, J.B., Holden, A.J., Robbins, D.J., and Stewart, W.J., "Low Frequency Plasmons in Thin–Wire Structures," J. Phys. Condens. Matter, 10 (1998) pp. 4785–4809.

Pendry, J.B., Holden, A.J., Robbins, D.J., and Stewart, W.J., "Magnetism from Conductors and Enhanced Nonlinear Phenomena." IEEE Transactions on Microwave Theory and Techniques, vol. 47, No. 11, Nov. 1999, pp. 2075–2084.

Smith, D.R., Padilla, W.J., Vier, D.C.,, Nemat–Nasser, S.C., and Schultz, S., "Composite Medium with Simultaneously Negative Permeability and Permittivity." Physical Review Letters, The American Physical Society, vol. 84, No. 18, May 1, 2000.

Pendry, J.B., "Negative Refraction Makes a Perfect Lens." Physical Review Letters, vol. 85, No. 18, Oct. 30, 2000, pp. 3966–3969.

Ward, A.J., and Pendry, J.B., "Refraction and Geometry in Maxwell's Equations." Journal of Modern Optics, 1996, vol. 43, No. 4, pp. 773–793.

Pendry, J.B., and Ramakrishna, S.A., "Focusing Light Using Negative Refraction." J. Phys. Condens. Matter 15 (2003), pp. 6345–6364.

* cited by examiner

*Primary Examiner*—Tho Phan
(74) *Attorney, Agent, or Firm*—Reinhart Boerner Van Deuren s.c.

(57) ABSTRACT

A method for making an antenna and the antenna itself are described. The antenna comprises a first region having a first refractive index and a second region having a negative refractive index, the second region substantially surrounding the first region, such that radiation outside the second region is reproduced in the first region.

20 Claims, 16 Drawing Sheets

NARROW BEAM ANTENNA

BACKGROUND OF THE INVENTION

Field of the Invention

This invention relates generally to antennae and in particular to narrow band antennae.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

To define the direction of radiation D with angular precision $\Delta\theta$ requires an aperture of, $$D=1.22\lambda/\Delta\theta \tag{1}$$

or so say the text books on optics. Therefore to define the direction of a beam in the horizontal plane a large area is conventionally needed.

As illustrated in FIG. 1, devices detect the direction of a wave by the oscillations on the surface of the detector. A larger detector senses more oscillations and is therefore more sensitive to direction.

Basically this is because the wave field has to execute a number of oscillations on the circumference of this area before we can tell where it is coming from: the fewer the oscillations the poorer the angular resolution. Mathematically speaking the wave field may be written as, $$H_z = H_0\exp(ikr\cos\theta - i\omega t) = H_0\sum_{m=-\infty}^{m=+\infty} J_m(kr)i^m\exp(im\theta - i\omega t) \tag{2}$$

where for illustration a wave polarized with the E field in the horizontal plane and the H field parallel to the z-axis is assumed. The Bessel function $J_m$ is central to the issue of directionality. Roughly speaking, $$|J_m(kr)\approx 1\ kr>m$$
$$\approx 0 kr<m \tag{3}$$

The number of oscillations of the wave field around the circumference is restricted by the size of kr and hence the limitations on resolution. FIG. 2 shows a plot of $J_{m=9}(kr)$ using data taken from M. Abramowitz and I. A. Stegun, "Handbook of Mathematical Functions" Dover, N.Y. (1972), which is hereby incorporated herein by reference in its entirety.

Additional references which are useful as background to the subject matter contained herein are: J. D. Lawson, *Journal IEE* 95 part III p363 (1948); V. G. Veselago, *Sov. Phys. USP.* 10 509 (1968); J. B. Pendry, A. J. Holden, W. J. Stewart, I. Youngs, *Phys. Rev. Lett.* 76 4773–6 (1996); J. B. Pendry, A. J. Holden, D. J. Robbins; and W. J. Stewart, *J. Phys.* [*Condensed Matter*] 10 4785–809 (1998); J. B. Pendry, A. J. Holden, D. J. Robbins, and W. J. Stewart, *IEEE transactions on microwave theory and techniques* 47, 2075–84 (1999); D. R. Smith, W. J. Padilla, D. C. Vier, S. C. Nemat-Nasser, S. Schultz. *Phys. Rev. Lett.* 84, 4184–4187 (2000); J. B. Pendry, *Phys. Rev. Lett.* 85 3966 (2000); A. J. Ward, and J. B. Pendry, *Journal of Modern Optics,* 43 773–93 (1996); and J. B. Pendry and S. A. Ramakrishna, *J. Phys.* [*Condensed Matter*] 15 6345–64 (2003), all of which are hereby incorporated herein by reference in their entirety.

As shown in FIG. 2, the Bessel function $J_{m=9}(kr)$ controls the amplitude of the $9^{th}$ order oscillations on the surface of the detector. Evidently if the detector is small so that kr<<9, then there is a weak contribution and the angular sensitivity of the device is reduced.

However equation (3) is only approximately true. In principle we could take a circle with a small circumference and with a highly sensitive piece of apparatus measure the amplitude of the high frequency angular components. This is a severe challenge because, although these amplitudes are always finite, their magnitude diminishes very rapidly as the radius shrinks. To illustrate the point we give an approximate expression, $$J_m(kr) \approx \frac{\left(\frac{1}{2}kr\right)^m}{m!} kr << m \tag{4}$$

For example for a structure of diameter $r=\lambda/\pi$, $$J_m(1) \approx \frac{1}{m!} \approx m^{-m}e^m,\ 1<<m \tag{5}$$

hence $J_9(1)=2.76\times10^{-6}$ and this is the magnitude of the signal we would need to detect for an angular resolution of only 360°/m=40°. The sensitivity required increases dramatically as the radius shrinks relative to the wavelength.

This trade off between sensitivity and angular resolution for small apertures must always be born in mind whatever other means are devised for obtaining high resolution. One way or another a very sensitive amplifier is required. Conversely, if a highly directional signal is to be radiated from a compact structure, very high intensity fields must be injected at some points on the structure.

SUMMARY OF THE INVENTION

The needs identified in the foregoing, and other needs and objects that will become apparent from the following description, are achieved in the present invention, which comprises, in one aspect, an antenna comprising a first region having a first refractive index, and a second region having a negative refractive index, wherein the second region substantially surrounds the first region, such that radiation outside the second region is reproduced in the first region.

In another aspect of the present invention, a method of producing an antenna it taught comprising providing a first region having a first refractive index, and providing a second region having a negative refractive index, wherein the second region substantially surrounds the first region, such that radiation outside the second region is reproduced in the first region.

In the following we present a system for creating high angular sensitivity in a compact structure. The demands of sensitivity places severe demands on the properties and manufacture of the components and some of the issues this may involve are discussed. The central element is the negatively refracting materials that have recently appeared onto the electromagnetic scene. These have introduced new possibilities for control of electromagnetic fields and particularly for manipulation of the near fields, which are important ingredients of compact directional aerials.

To sense the direction of radiation precisely with a small diameter aperture the rapidly oscillating components that give the directional information need to be amplified.

DESCRIPTION OF THE DRAWINGS

The invention will now be described further, by way of example only, with reference to the accompanying drawings, in which.

DETAILED DESCRIPTION OF THE PREFERRED EMBODIMENT

A narrow beam antenna is described. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Figure 3:
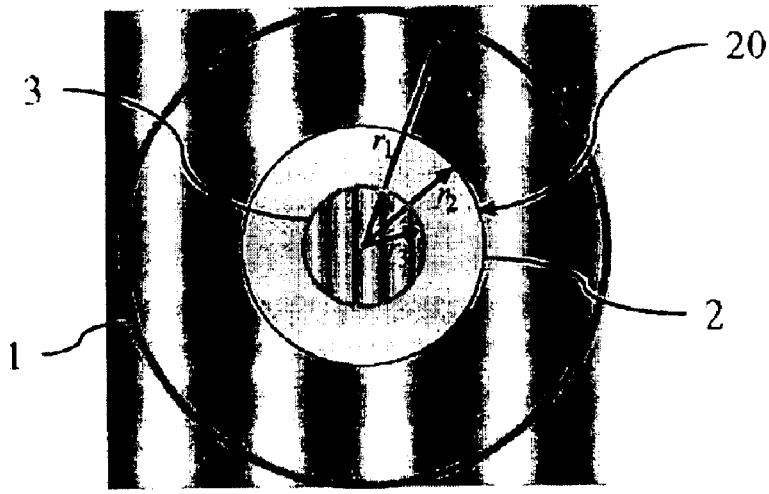
FIG. 3 illustrates a first embodiment of an electromagnetic antenna.

In the following sections, the use of negatively refracting materials to compress an incoming wave into a smaller volume is discussed. FIG. 3 illustrates the plan view of an antenna. The antenna 20 comprises a first cylinder 3 of radius $r_3$ and a second cylinder 2 of radius $r_2$ surrounding the first cylinder 3. The outer cylinder 2 comprises a negatively refracting material, contained within the cylinder 2 of radius $r_2$ such that, as far as observers external to $r_2$ are concerned, it is completely invisible. In other words it does not scatter incident radiation. The region inside the smallest cylinder 3, radius $r_3$, is filled with a material whose refractive index is, $$n=r_2^2/r_3^2 \tag{6}$$

and within this inner cylinder 3 an observer will see a compressed version of the incident wave. The compression factor is simply the refractive index, n. This structure maps the contents of a larger cylinder 1 of radius $r_1$ into the smaller cylinder 3, where $$r_1=nr_3=r_2^2/r_3 \tag{7}$$

FIG. 3 shows an embodiment of a narrow beam antenna 20. A suitably designed negative material (gray shading) placed in the cylindrical annulus between $r_2$ and $r_3$ will compress the wave field originally within the cylinder $r_1$ to fit inside the smallest cylinder radius $r_3$.

We now have a short wavelength version of the incident wave travelling in the same direction and hence we can employ our detector of choices, e.g. a horn antenna or dipole array, to detect the radiation, but with the length scale reduced by a factor of n and therefore with enhanced directionality. It will be obvious from reciprocity that an aerial radiating short wavelengths inside the small cylinder will result in a highly directional beam emerging into vacuum. By making a structure of radius $r_2$ we have is gained an effective aperture of radius $r_1$. The region between $r_1$ and $r_2$ is empty space and therefore the effective "gain" in aperture is a factor of $n=r_2^2/r_3^2$.

Negative Refraction

This simple conclusion results from some complex mathematics. Negative materials will be described in the next section, then the design procedure will be explained as well as the materials needed to complete the design.

The refractive index defines the relationship between wave vector, k, and frequency, ω, when an electromagnetic wave propagates through a material:

$$k=n\omega \tag{8}$$

where, $$n=\sqrt{\epsilon\mu} \tag{9}$$

and ϵ is the electrical permittivity, μ the magnetic permeability. We know that if either one of these quantities is negative then a wave propagating in such a material would result in an imaginary value of n and hence of k. This happens at optical frequencies in metals and the imaginary wave vector means that light does not penetrate far into a metal and is almost completely reflected.

Some years ago Veselago (V. G. Veselago, *Sov. Phys. USP.* 10 509 (1968)) pointed out that some very strange things occur when both ϵ and μ take negative values: k is once again real but with a strange twist. He argued than whereas we usually choose n to be positive, in this new situation we are forced to choose the negative sign for the square root in (9). Although there has been some heated debate about the sign of n the conclusion, now backed by several experiments, is that choice of the negative sign gives the correct results for refraction in negative media.

Figure 4:
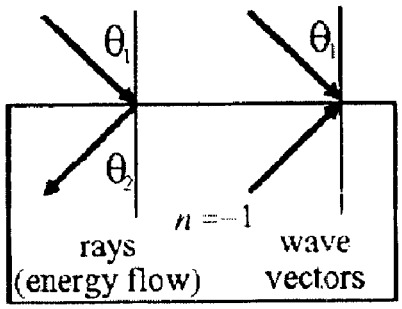
FIG. 4 illustrates refraction in a negative refractive index medium.

Amongst the strange effects noted by veselago was the curious refraction of radiation at a surface. The negative refractive index implies that radiation refracts to the "wrong" side of the normal giving rise to the chevron style diffraction shown in FIG. 4. As shown in FIG. 4, radiation refracts into a negative refractive index medium. On the left we see the ray diagrams and on the right the direction of the wave vectors. Note that the wave vector is oppositely directed to the group velocity which defines the direction of the rays. It follows from these laws of refraction that a focussing effect can be achieved by a slab of negative material.

Figure 5:
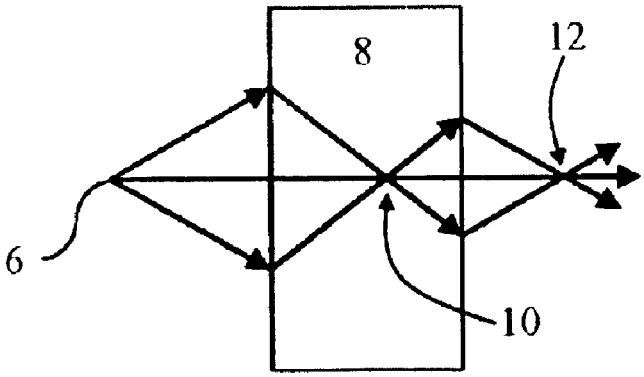
FIG. 5 illustrates the influence of a negative refractive index medium.

FIG. 5 shows the laws of refraction applied to rays emanating from a point source 6 near a negative slab 8. Two foci 10, 12 are achieved: one (10) inside and one (12) outside the medium 8. In the case of n=−1 the focussing is free of aberration, but otherwise not so.

As shown in FIG. 5, a negative refractive index medium 8 bends light to a negative angle relative to the surface normal. Light formerly diverging from a point source is set in reverse and converges back to a point. Released from the medium the light reaches a focus for a second time.

Materials with $\epsilon<0$ are relatively easy to find. At optical frequencies metals have this property, and at lower frequencies a lattice of thin metallic wires has very similar properties with a plasma like form to the dielectric function, $$\epsilon=1-\omega_p^2/\omega(\omega+i\gamma) \tag{10}$$

Figure 6:
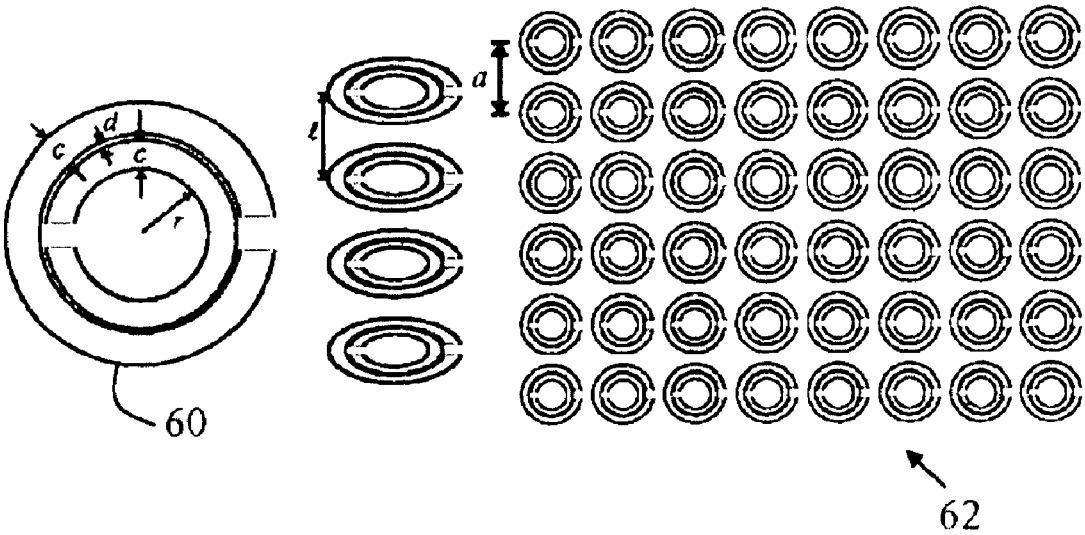
FIG. 6 illustrates an example of a negative refractive index material, this material comprising a split ring structure.

The paper by J. B. Pendry, A. J. Holden, D J Robbins, and W. J. Stewart, *IEEE transactions on microwave theory and techniques* 47, 2075–84 (1999) shows how to make an artificial material with a magnetic response that is effectively negative. This is the "split ring" structure shown in FIG. 6. The left-hand part of FIG. 6 is a plan view of a split ring 60. The middle part of FIG. 6 shows a sequence of split rings shown in their stacking sequence separated by a distance l. Each split ring comprises two thin sheets of metal. The right-hand view is a plan view of a split ring structure 62 in a square array. Typical dimensions for the split rings are as follows:

Inner radius r=2.0 mm

Width c of each ring=1.0 mm

Spacing d between ring edges=0.1 mm

Lattice constant a,l=10.00 mm

Figure 7A:
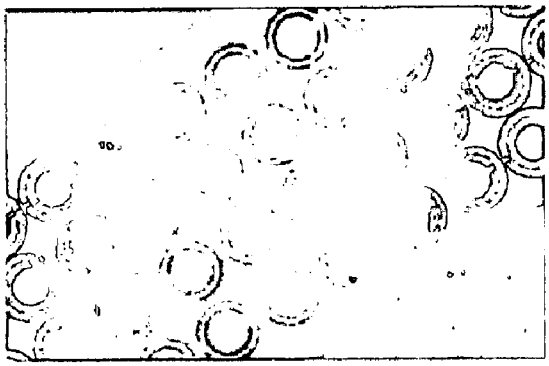
FIGS. 7*a* and 7*b* illustrate a split ring structure and its permeability.
Figure 7B:
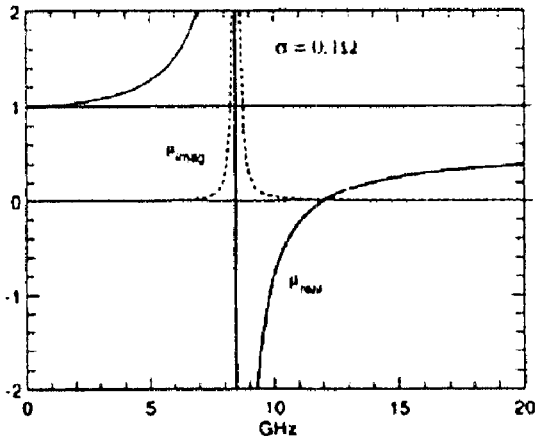

FIG. 7*a* shows a split ring structure etched into copper circuit board to give negative $\mu$ and FIG. 7*b* shows schematic: values of the permeability for a lossy structure.

FIG. 7*a* shows one of the early realizations of the split rings structures, and typical values obtained for the permeability. The figure illustrates two important points: firstly negative materials are strongly dispersive with frequency, often taking a strongly resonant form; and secondly loss is often a feature in these systems and great care must be taken to minimize it.

The paper D. R. Smith, W. J. Padilla, D. C. Vier, S. C. Nemat-Nasser, S. Schultz. *Phys. Rev. Lett.* 84 4184–4187 (2000) describes a realization of a material with both $\epsilon<0$, $\mu<0$ and hence with negative refractive index. Their pioneering work has been confirmed by numerous subsequent studies both experimental and theoretical.

However the key concept for the purposes of the present work was introduced in J. B. Pendry, *Phys. Rev. Lett.* 85 3966 (2000) where it was pointed out that the focussing action noted by Veselago and illustrated in FIG. 5 was far more general than had been realized. Not only does the slab of n=−1 material bring the "rays" to a focus, it also acts on the near field components of the object forcing them to contribute to the image.

Conventionally the near field dies away rapidly with distance and so fails to contribute to a conventional image. In contrast the slab of negative material actually amplifies the near field and so gives the correct contribution to the image of all components, near and far field. This means that the image is in principle perfect, through to achieve perfection the material must be completely free of any loss. However even with a lossy sample it is possible to get sub-wavelength resolution and to do better than a conventional lens.

Figure 8:
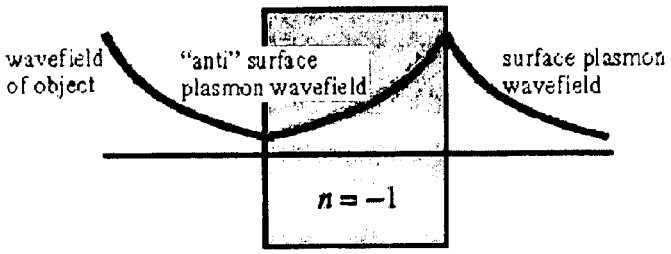
FIG. 8 illustrates the interaction of an object on a negative refractive index material.

As shown in FIG. 8, the strongly decaying near field of the object excites a surface resonance in the negative material and this resonant amplification brings the wavefield back to the correct amplitude. Hence in principle we are able to construct a "perfect lens."

Figure 1:
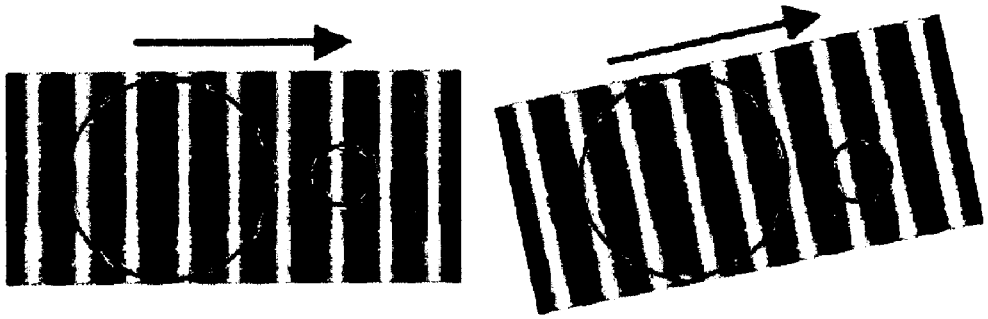
FIG. 1 illustrates how devices detect the direction of waves by the oscillations on the surface of a detector.
Figure 2:
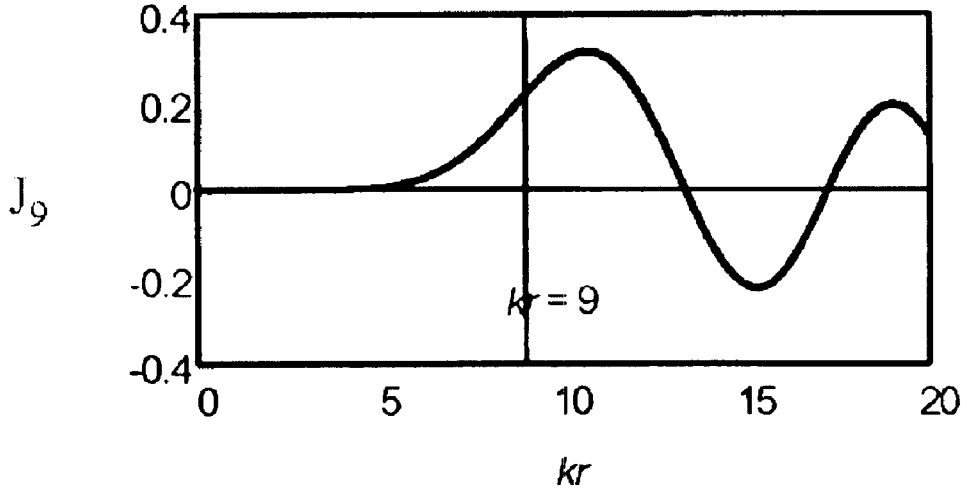
FIG. 2 illustrates the Bessel function with m=9.

This ability to manipulate the near field with the same precision as the far field is the key to designing a compact highly directional aerial. As mentioned earlier, the high-angular-resolution components of the wave field are much reduced in amplitude inside, a small volume (see FIG. 2). Essentially they become part of the near field and to extract the angular information they must be amplified. This is similar to the problem solved by the "perfect lens." To return to FIG. 3, where we show the incident wave field compressed into a small volume, this compression is obtained by amplifying the near field components through resonant excitation of surface modes in the negative material of cylinder 2. There will be very large field intensities present within the negative materials and this will be one of the issues with which our design must cope.

Methodology used to Design the Device

We begin with the philosophy that diffraction of waves is easy to understand when the geometry is simple. For example refraction of radiation at the interface between two dielectrics can easily be solved and results in Snell's law for the change in angle at the interface. Refraction at a curved surface is more difficult to calculate especially if the radius of curvature is comparable to the wavelength. Now we make an analogy: we can physically take a slab of dielectric and shape it into a curved surface. For example we could make a cylinder from the dielectric. Mathematically we could do the same trick by bending the coordinate system changing it from a rectilinear Cartesian system to a cylindrical one.

Some time ago Ward and Pendry (A. J. Ward, and J. B. Pendry, *Journal of Modern Optics,* 43 773–93 (1996)) showed how to rewrite Maxwell's equations in a new coordinate system. They concluded that the equations had the same form as the original Maxwell's equations, but the bending changed the values of $\epsilon,\mu$ that appeared in the equations. The precise values of the fields also changed, but what stayed the same were the trajectories of rays and the places where they came to a focus. We are going to use this idea to shape a slab of negatively refracting material into a cylindrical lens with the properties outlined. First we need some mathematics which we take from the original Ward and Pendry paper.

Figure 9:
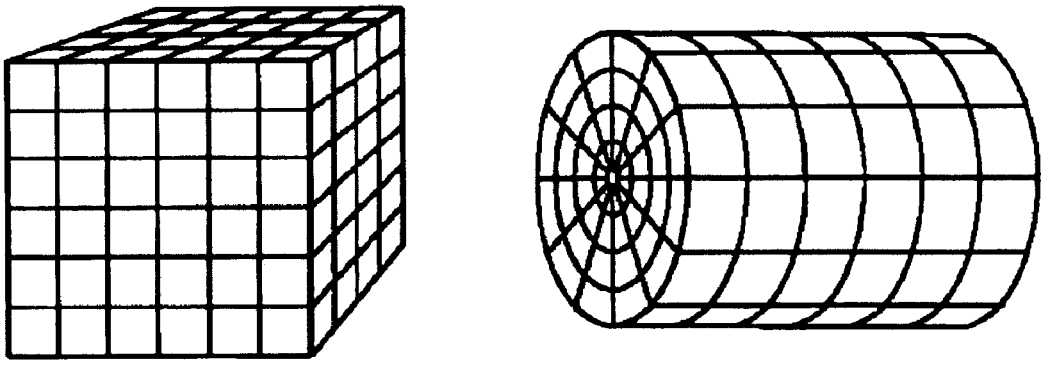
FIG. 9 shows a Cartesian and an cylindrical co-ordinate system.

FIG. 9 shows, on the left, a Cartesian coordinate mesh and on the right the mesh for a cylindrical coordinate system.

If Maxwell's equations are rewritten in a new coordinate system they take exactly the same form as in the old system provided that we re-normalize $\epsilon$ and $\mu$ according to a simple rule. This affords a huge saving in effort because it reduces what appears to be a new problem to an old one: that of solving for the wave field on a uniform mesh in a non uniform medium.

Consider a general coordinate transformation from a Cartesian, x,y,z, frame to a new set of axes, $$q_1(x,y,z),\ q_2(x,y,z),\ q_3(x,y,z), \tag{11}$$

Three unit vectors, $u_1,u_2,u_3$, point along each of the axes $q_1,q_2,q_3$ respectively. Next we introduce the length of a line element, $$ds^2=dx^2+dy^2+dz^2$$

$$=Q_{11}dq_1^2+Q_{22}dq_2^2+Q_{33}dq_3^2+2Q_{12}dq_1dq_2+2Q_{13}dq_1dq_3+2Q_{23}dq_2dq_3 \quad (12)$$

where, $$Q_{ij}=\frac{\partial x}{\partial q_i}\frac{\partial x}{\partial q_j}+\frac{\partial y}{\partial q_i}\frac{\partial y}{\partial q_j}+\frac{\partial z}{\partial q_i}\frac{\partial x}{\partial q_j} \quad (13)$$

If the line element is directed along one of the three axes $q_i$, $$ds_i=Q_idq_i \quad (14)$$

where, $$Q_i^2=Q_{ii} \quad (15)$$

Using these quantities we can rewrite Maxwell's equations in terms of the coordinates $q_1,q_2,q_3$: (see A. J. ward, and J. B. Pendry, *Journal of Modern Optics,* 43 773–93 (1996) for details), $$(\nabla_q\times\hat{E})^i=-\mu_0\sum_{j=1}^{3}\hat{\mu}^{ij}\frac{\partial\hat{H}_j}{\partial t} \quad (16a)$$

$$(\nabla_q\times\hat{H})^i=+\varepsilon_0\sum_{j=1}^{3}\hat{\varepsilon}^{ij}\frac{\partial\hat{E}_j}{\partial t} \quad (16b)$$

which as promised are identical in form to the familiar equations written in a Cartesian system of coordinates. The re-normalized quantities are, $$\hat{\epsilon}^{ij}=\epsilon g^{ij}|u_1\cdot(u_2\times u_3)|Q_1Q_2Q_3(Q_iQ_j)^{-1} \quad (17a)$$

$$\hat{\mu}^{ij}=\mu g^{ij}|u_1\cdot(u_2\times u_3)|Q_1Q_2Q_3(Q_iQ_j)^{-1} \quad (17b)$$

where, $$g^{-1}=\begin{bmatrix} u_1\cdot u_1 & u_1\cdot u_2 & u_1\cdot u_3 \\ u_2\cdot u_1 & u_2\cdot u_2 & u_2\cdot u_3 \\ u_3\cdot u_1 & u_3\cdot u_2 & u_3\cdot u_3 \end{bmatrix} \quad (18)$$

The new fields are given by, $$\hat{E}_j=Q_jE_j,\ \hat{H}_j=Q_jH_j \quad (19)$$

These results greatly simplify if the new system of axes is orthogonal, i.e. if $u_1,u_2,u_3$ are orthogonal vectors, since in that case g is a unit matrix $$g=\begin{bmatrix} 1 & 0 & 0 \\ 0 & 1 & 0 \\ 0 & 0 & 1 \end{bmatrix} \quad (20)$$

and, $$u_1\cdot(u_2\times u_3)=1 \quad (21)$$

Ward and Pendry tested these transformations in the case of a cylindrical wave guide with perfect metal boundaries and found that the distorted mesh shows the same excellent convergence as the original uniform version.

Figure 10:
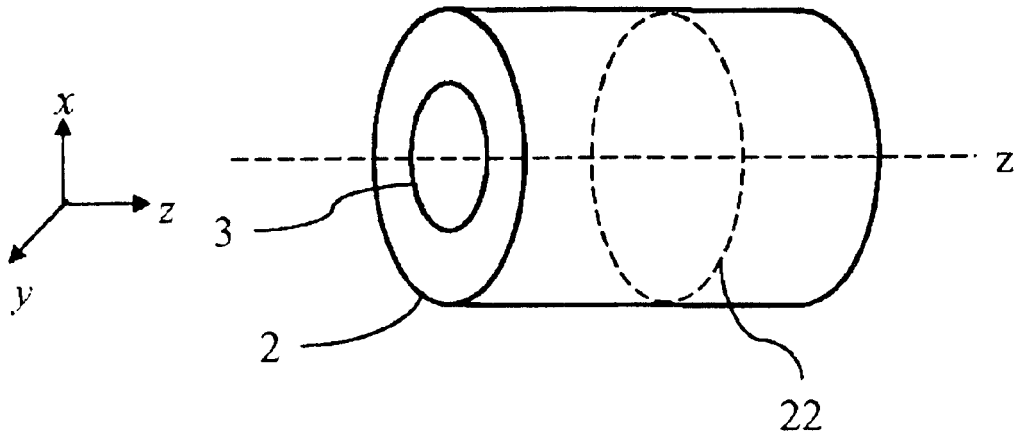
FIG. 10 illustrates a wave vector along a cylindrical wave guide.

FIG. 10 shows a three dimensional implementation of an antenna. In the embodiment shown the antenna comprises a first cylinder 3 of a first, generally positive, refractive index, and a second outer cylinder 2 of a negative refractive index. The x-y plane 22 is perpendicular to the longitudinal axis z of the cylinders. The length of the cylinders defines the angular resolution in a plane including the longitudinal axis z of the cylinders.

Figure 11:
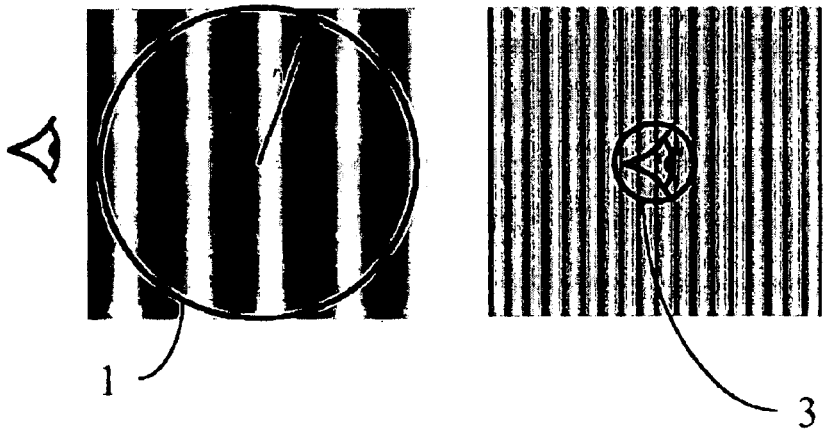
FIG. 11 illustrates the objective of a narrow beam antenna.

In an antenna as illustrated in FIGS. 3 and 10, an external wave incident on the cylindrical system is compressed into an inner region 3 where it has a shorter wavelength and hence can be detected by a small device with enhanced angular precision. FIG. 11 shows the appearance of the system to external and to internal observers: to viewers outside the cylinder 1, the cylinder 1 of radius $r_1$ appears to be filled with a radially magnified version of the contents of the smaller cylinder 3, radius $r_3$. Hence the system is invisible and appears to be transparent to incident radiation.

Viewed from inside the smaller cylinder 3, the world beyond $r_3$ seems to be filled with a miniature version of the region external to $r_1$. To observers internal to the circle 3, there is also no evidence of the boundary at $r=r_3$ which is perfectly transparent to outgoing radiation. The material between $r_1$ and $r_3$ acts as a wavelength expander/contractor. The radial magnification factor is $r_1/r_3$. Provided that an observer stays outside or inside the relevant boundaries, he has no means of detecting that the boundaries are there. It should be stressed once more that these statements apply only at one highly specific frequency at which the device is designed to operate.

Figure 12:
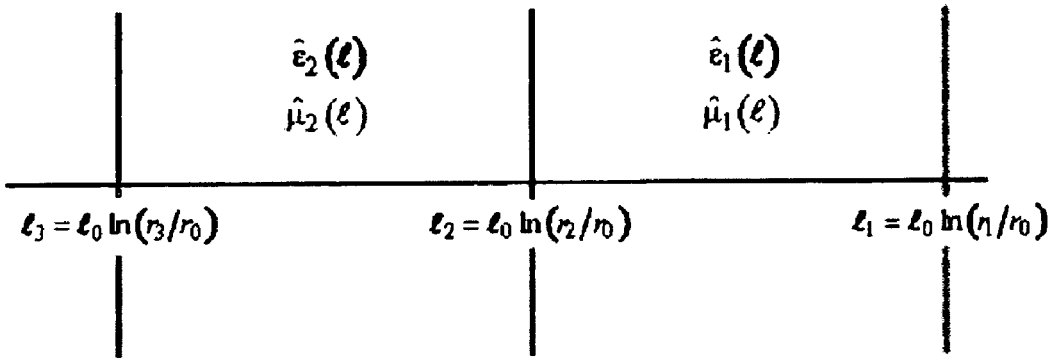
FIG. 12 illustrates how co-ordinates of a cylindrical coordinate system are mapped to planes.

Therefore the system is designed which, from the point of view of radiation, eliminates the space $r_1>r>r_3$. The methodology is as follows: to identify another system which is known to eliminate a region of space, possibly of a different shape, and then to apply a transformation of coordinates that reshapes the known region to the desired region. We shall exploit a result recently derived in J. B. Pendry and S. A. Ramakrishna, *J. Phys.* [*Condensed Matter*] 15 6345–64 (2003) that regions of space filled with negative material can optically compensate for positive regions: the two regions effectively cancel one another from an optical standpoint. For example as shown in FIG. 12, if we choose, $$\hat{\epsilon}_2(l)=-\hat{\epsilon}_1(2l_2-1),\ \hat{\mu}_2(l)=-\hat{\mu}_1(2l_2-1),\ l_3<l<l_2 \quad (22)$$

Then not only is the region between $l_2$ and $l_3$ perfectly transparent to radiation, but also radiation crosses this region with no change of phase or amplitude. optically speaking this space does not exist. The antenna, described exploits this result.

As shown in FIG. 10, in the new coordinate system cylinders are mapped into planes of constant l.

Since we have shown how to relate coordinate transformations to changes in $\epsilon,\mu$, we can use the transformation to deduce what values of $\epsilon,\mu$ to choose in the region $r_3<r<r_1$. We divide this region into two further domains, $$\epsilon_1(r)=\mu_1(r),\ r_2<r<r_1,$$
$$\epsilon_2(r)=\mu_2(r),\ r_3<r<r_2 \quad (23)$$

We then need to determine the values for $\epsilon_1,\mu_1,\epsilon_2,\mu_2$ so that the system behaves as required.

Having defined the cylinders in the x,y,z coordinate we now define a new set of coordinates, $l,\phi,Z$ so that, in the new coordinate system, the boundaries appear not as cylinders but as planes:

$$x=r_0e^{l/l_0}\cos\phi,\ y=r_0e^{l/l_0}\sin\phi,\ z=Z \quad (24)$$

Next we calculate the quantities needed to map from the old to the new coordinate system. From equation (13) we have, $$Q_l=r_0/l_0\sqrt{e^{2l/l_0}\cos^2\phi+30e^{2l/l_0}\sin^2\phi}=r_0/l_0e^{l/l_0}$$

$$Q_\phi=r_0\sqrt{e^{2l/l_0}\sin^2\phi+30e^{2l/l_0}\cos^2\phi}=r_0e^{l/l_0} \tag{25}$$

$$Q_Z=1$$

$$Q_lQ_\phi Q_Z=r_0^2/l_0e^{2l/l_0}$$

The new $\hat{\epsilon},\hat{\mu}$ follow from (17), $$\hat{\epsilon}_1=l_0\epsilon_1,\ \hat{\epsilon}_\phi=l_0^{-1}\epsilon_\phi,\ \hat{\epsilon}_Z=r_0^2/l_0e^{2l/l_0}\epsilon_z$$

$$\hat{\mu}_1=l_0\mu_1,\ \hat{\mu}_\phi=l_0^{-1}\mu_\phi,\ \hat{\mu}_Z=r_0^2/l_0e^{2l/l_0}\mu_z \tag{26}$$

and the new fields follow from (19), $$\hat{E}_l=Q_l[+E_x\cos\phi+E_y\sin\phi],\ \hat{E}_\phi=Q_\phi[-E_x\sin\phi+E_y\cos\phi],\ \hat{E}_Z=Q_ZE_z$$

$$\hat{H}_l=Q_l[+H_x\cos\phi+H_y\sin\phi],\ \hat{H}_\phi=Q_\phi[-H_x\sin\phi+H_y\cos\phi],\ \hat{H}_Z=Q_ZH_z \tag{27}$$

hence, $$\hat{E}_l=r_0/l_0e^{l/l_0}[+E_x\cos\phi+E_y\sin\phi],\ \hat{E}_\phi=r_0e^{l/l_0}[-E_x\sin\phi+E_y\cos\phi],\ \hat{E}_Z=E_z$$

$$\hat{H}_l=r_0/l_0e^{l/l_0}[+H_x\cos\phi+H_y\sin\phi],\ \hat{H}_\phi=r_0e^{l/l_0}[-H_x\sin\phi+H_y\cos\phi],\ \hat{H}_Z=H_z \tag{28}$$

We now come to our result: if in FIG. 12 we can define $\hat{\epsilon}_1,\hat{\mu}_1$ and $\hat{\epsilon}_2,\hat{\mu}_2$ so that they are inverse mirror images of one another about the line $l_2=l_0\ln(r_2/r_0)$ then, from an electromagnetic point of view, the two regions annihilate one another and, as far as the system outside the lines $l_3$ and l, is concerned, the central region does not exist. We make our symmetrical choice as follows (it is not unique).

First we set, $$l_0=1$$

then for the outer region, $$\hat{\epsilon}_1=+1,\ \hat{\epsilon}_\phi=+1,$$

$$\hat{\epsilon}_Z=+r_0^2e^{2l},\ \ln(r_2/r_0)<l \tag{29}$$

for the middle region, $$\hat{\epsilon}_1=-1,\ \hat{\epsilon}_\phi=-1,$$

$$\hat{\epsilon}_Z=-r_0^2e^{4l_2-2l},\ \ln(r_3/r_0)<l<\ln(r_2/r_0) \tag{30}$$

and for the inner region, $$\hat{\epsilon}_1=+1,\ \hat{\epsilon}_\phi=+1,$$

$$\hat{\epsilon}_Z=+r_0^2e^{4l_2-4l_3+2l},\ l<\ln(r_3/r_0) \tag{31}$$

We also everywhere set, $$\mu_1=\epsilon_1,\ \mu_\phi=\epsilon_\phi,\ \mu_Z=\epsilon_Z \tag{32}$$

Figure 13:
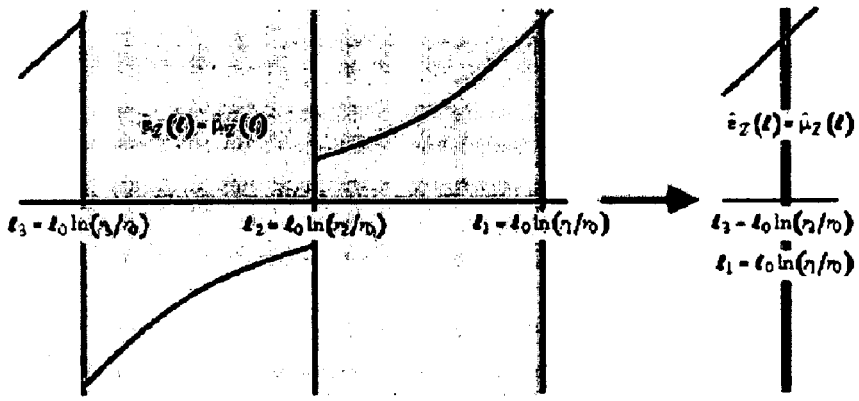
FIG. 13 illustrates the variation of $\hat{\epsilon}_Z$ with l.

In FIG. 13 we give a schematic plot of $\hat{\epsilon}_Z$. Note the antisymmetry about the point $l_2=l_0\ln(r_2/r_0)$, $$\epsilon(l_2+\delta)=-\epsilon(l_2-\delta),$$

$$\mu(l_2+\delta)=-\mu(l_2-\delta), \tag{33}$$

This enables us to invoke the theorem that antisymmetrical regions optically annihilate one another.

FIG. 11 shows the variation of $\hat{\epsilon}_Z$ with l. Note that within the shaded region $\hat{\epsilon}_Z$ is anti-symmetrical about $l_2=l_0\ln(r_2/r_0)$ as required for focussing. Optically speaking we can remove the shaded region and close the gap.

Next we use equations (26) to transform to the xyz coordinate frame to give for the region outside the cylinder radius $r_2$, $$\epsilon_x=+1,\ \epsilon_y=+1,\ \epsilon_z=+1,\ r>r_2$$

$$\epsilon_x=-1,\ \epsilon_y=-1,\ \epsilon_z=-r_2^4/r^4,\ r_3<r<r_2 \tag{34}$$

$$\epsilon_x=+1,\ \epsilon_y=+1,\ \epsilon_z=+r_2^4/r_3^4=+r_1^2/r_3^2,\ r<r_3$$

and with identical values for, $$\boxed{\mu_x=\varepsilon_x,\quad \mu_y=\varepsilon_y,\quad \mu_z=\varepsilon_z} \tag{35}$$

Equations (34) and (35) define the structure we wish to create.

Figure 14:
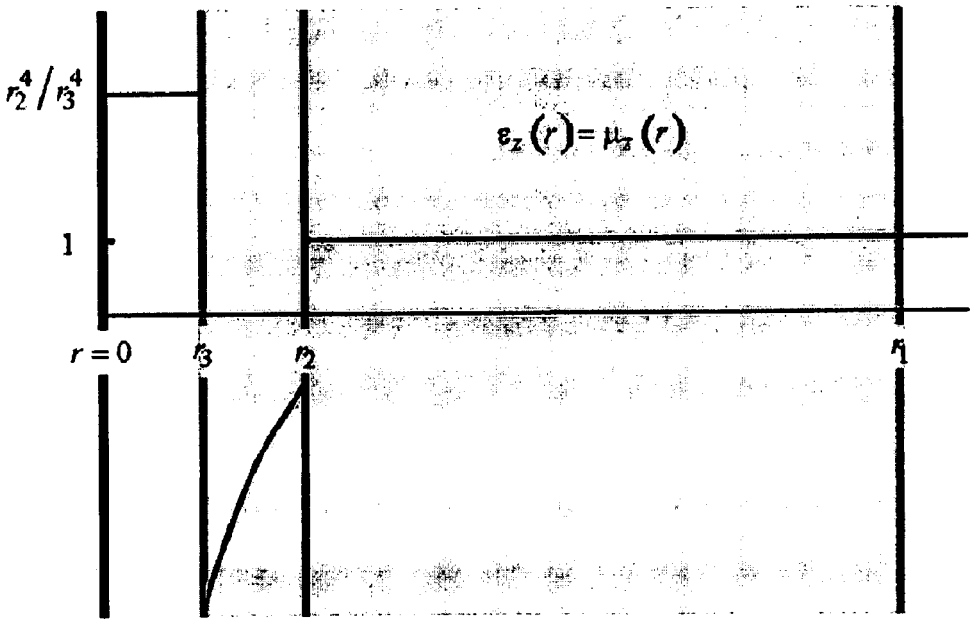
FIG. 14 illustrates the variation of $\epsilon_Z(r)$ with $r=\sqrt{x^2+y^2}$.

FIG. 14 shows a schematic plot of $\epsilon_z$. Note that $\epsilon_z$ takes the free space value of $\epsilon_z=1$ for $r>r_2$, and a constant value for $r<r_3$. FIG. 12 shows the variation of $\epsilon_z(r)$ with radius $r=\sqrt{x^2+y^2}$. Note that $\epsilon_z$ is constant outside the "active region" $r_3<r<r_2$ where the focussing takes place.

Figure 15:
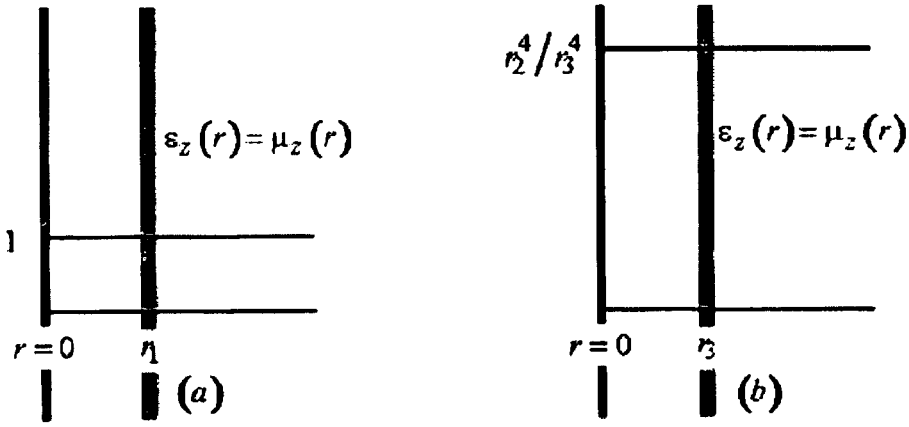
FIG. 15 illustrates optical behavior of an antenna as illustrated in FIG. 3.

Now let us take the further step of asking what happens when we eliminate the gray region from FIG. 13. FIG. 15 shows the optical behavior of the system taking account of cancellation between the antisymmetric regions. As illustrated in FIG. 15*a* (on the left), when viewed from a point external to the outer cylinder 1, radius $r_1$, the whole of space appears as though it were vacuum. As illustrated in FIG. 15*b* (on the right), when viewed from a point inside the inner cylinder 3 radius $r_3$ the whole space appears as though $\epsilon=\mu=r_2^4/r_3^4$. If we view the system from outside, then the outer region finishes at, $$l_1=l_0\ln(r_1/r_0) \tag{36}$$

where the inner region begins. Transforming the truncated system back into the xyz coordinate system leads to FIG. 15*a*.

Alternatively if we view the system from inside, then the inner region finishes at, $$l_3=l_0\ln(r_1/r_0) \tag{37}$$

where the outer region begins. Transforming the truncated system back into the xyz coordinate system leads to FIG. 15*b*. Thus, when receiving waves from the outside world, the inner region sees the waves as obeying Maxwell's equations $$\omega c_0^{-1}=\pm\sqrt{\frac{k_r^2}{\varepsilon_x\varepsilon_z}+\frac{k_z^2}{\varepsilon_x^2}}=\pm\sqrt{(r_3^4/r_2^4)k_r^2+k_z^2}=\pm\sqrt{(r_3^2/r_1^2)k_r^2+k_z^2} \tag{38}$$

Since ω is fixed and $k_z$ is conserved, the in-plane component of wave vector, $k_r$, is increased by a factor $r_2^2/r_3^2=r_1/r_3$ relative to the incident wave.

The maximum aperture of a receiver inside the inner cylinder is, $$D=2r_3. \tag{39}$$

However, because the wavelength in the plane is reduced by a factor $r_3/r_1$, the resolving power is equivalent to an aperture in free space of $$D_{eff}=2r_3\times r_1/r_3=2r_1 \tag{40}$$

It is important to note that only the region, $$r<r_2=\sqrt{r_1r_3} \tag{41}$$

need be filled with material and the region, $$r>r_2 \tag{42}$$

is free space. Therefore the material system is more compact than an equivalent free space system by a factor of C, where $$C=r_2/r_1=r_3/r_2 \tag{43}$$

Negative Refraction and Curved Surfaces

Figure 16:
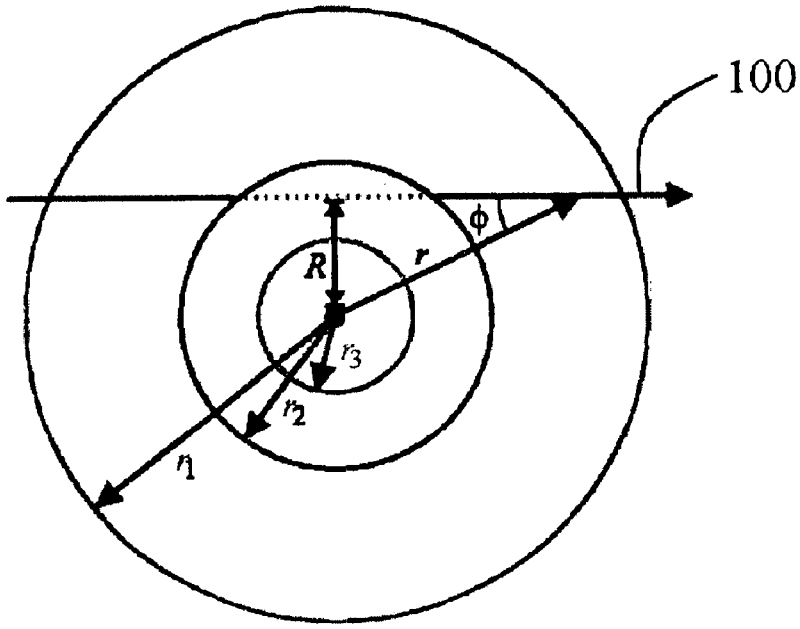
FIG. 16 illustrates the affect on a electromagnetic ray of an antenna as illustrated in FIG. 3.

In this section we shall explore how the structure designed interacts with electromagnetic waves and in particular how the fields are configured within the regions where $\epsilon,\mu$ are both negative. We begin with a simple ray tracing exercise and ask what is the trajectory of a ray which starts at infinity and interacts with our structure, as shown in FIG. 16.

FIG. 13 shows a ray 100 incident on a cylinder with impact parameter R. A point along the trajectory is defined by the angle $\phi$.

The trajectory has the following form in free space, $$r=R/\sin\phi,\ r>r_2 \tag{44}$$

where R is the impact parameter. We also know that the trajectory is compressed in the inner region, but still executes a straight line because the refractive index is constant, $$r=\frac{r_3^2}{r_2^2}R/\sin\phi=\frac{r_3}{r_1}R/\sin\phi,\quad r<r_3 \tag{45}$$

In the transformed coordinate frame, $$r=r_0\exp(l) \tag{46}$$

and therefore the trajectory becomes in the transformed frame, $$r_0\exp(l)=R/\sin\phi,\ l>l_2 \tag{47}$$

FIG. 14 shows a series of ray trajectories for the system we have designed. Trajectories 70 starting at infinity which hit the negatively refracting cylinder 2 are concentrated within the inner cylinder 3. Note the negative angles of refraction. In addition there is a set of closed trajectories 72 starting within the inner cylinder 3 which never escape from the system.

Invoking the symmetry of the trajectory we have, $$r_0\exp(2l_2-1)=R/\sin\phi,\ l_2<l<l_3 \tag{48}$$

or in the original frame, $$\frac{r_2^2}{r}=R/\sin\phi,\quad r_2<r<r_3 \tag{49}$$

This is the missing portion of the trajectory in the region where the refractive index is a function of radius. Remembering that, $$\frac{r_2^2}{r_3}=r_1 \tag{50}$$

we can also write, $$\frac{r_1r_3}{r}=R/\sin\phi,\quad r_2<r<r_3 \tag{51}$$

which shows explicitly that $\phi$ has the same value at $r_3$ as at $r_1$.

Figure 17:
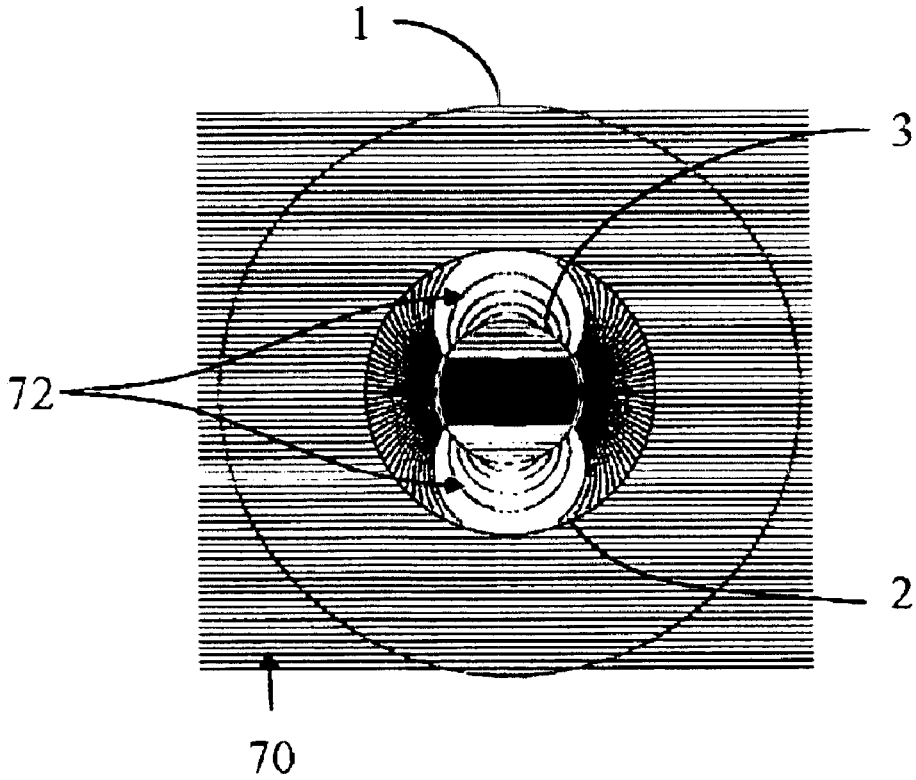
FIG. 17 is a ray diagram.

FIG. 17 shows a set of trajectories for a range of impact parameters. The prediction we made that the wave field inside the inner cylinder 3 is a compressed version of the contents of the outer cylinder 1 were it filled with free space is shown. The figure has several interesting features that will inform our more complete calculation below.

First note that only trajectories that impact upon the cylinder 2, radius $r_2$, are refracted to the inner cylinder 3. They are negatively refracted at both interfaces as required, arrive as predicted but fill only the middle half of the inner cylinder 3. Only those trajectories which strike the middle cylinder 2 are captured, the rest appear to escape. This appears to contradict the prediction that all of the light impacting on the outer cylinder, radius $r_1$, will pass through the inner cylinder 3.

The dilemma is resolved by the fact that we are dealing with waves and not with rays. The missing trajectories are indicated by the numeral 72. We see from the figure that they correspond to closed trajectories that never escape from the system. However this is true only in the ray approximation. The closed trajectories will in fact correspond to cavity resonances and when Maxwell's equations are solved will couple to the external rays. Energy will leak from the external rays to the internal resonances and in time the missing trajectories will be populated with energy. This process leads to the enhanced resolution.

Obviously the classical trajectories alone contain only the directional information available from an aperture the size of the middle cylinder 2 whereas the antenna resolution is of the same order as would be obtained in a conventional antenna with an aperture equal to that of the outer cylinder radius $r_1$. The effective aperture $r_1$ defines the angular resolution in a plane perpendicular to the longitudinal axis of the cylinders. The length of the cylinders defines the angular resolution in a plane including the longitudinal axis of the cylinders. Generally the length of the cylinders is great compared with the wavelength of the antenna.

To calculate how this system responds to an incident plane wave of the form, $$H_z=H_{z0}\exp(ikr\cos\phi-i\omega t),\ r>r_2 \tag{52}$$

we assume for simplicity that the wave vector is perpendicular to the axes of the cylinders, and that the magnetic field is parallel to the cylinder axis. Within the inner cylinder 3the wave field again has a plane wave format but with a shorter wavelength, $$H_{z0}\exp(ik[r_1/r_3]r\cos\phi-i\omega t),\ r<r_3 \tag{53}$$

Next we must find the fields in the region $r_3<r<r_2$ which we do by recognizing that $\epsilon,\mu$ in this region have been constructed to be antisymmetric to the outer region $r_2<r<r_1$. Therefore knowing the fields in $r_2<r<r_1$ we can calculate the fields in $r_3<r<r_2$. Substituting from (24) for the new coordinates, $l\phi Z$:

$$\hat{H}_Z=H_{z0}\exp(ikr_0e^l\cos\phi-i\omega t),\ l>l_2 \tag{54}$$

Invoking the antisymmetry principle between the two regions gives, $$\hat{H}_Z=H_{z0}\exp(ikr_0e^{2l_2-1}\cos\phi-i\omega t),\ l_3<l<l_2 \tag{55}$$

and substituting back into the original system gives, $$H_Z=H_{z0}\exp(ik[r_2^2/r]\cos\phi-i\omega t),\ r_3<r<r_2 \tag{56}$$

Equations (52), (53), (56) specify the fields everywhere. It is easy to check that these fields satisfy the boundary conditions at the two interfaces, and are solutions of Maxwell's equations in each of their domains.

FIG. 15 shows the magnetic field of a plane wave incident on the system represented as an amplitude map. The contours map the phase fronts and the wave velocity heads normal to the fronts. When compared to FIG. 17 it is noted that the two sets of lines are roughly orthogonal as they should be. Note also that a proper solution of Maxwell's equations has now filled in the missing intensity inside the inner cylinder 3 where the amplitude is uniform.

Figure 18:
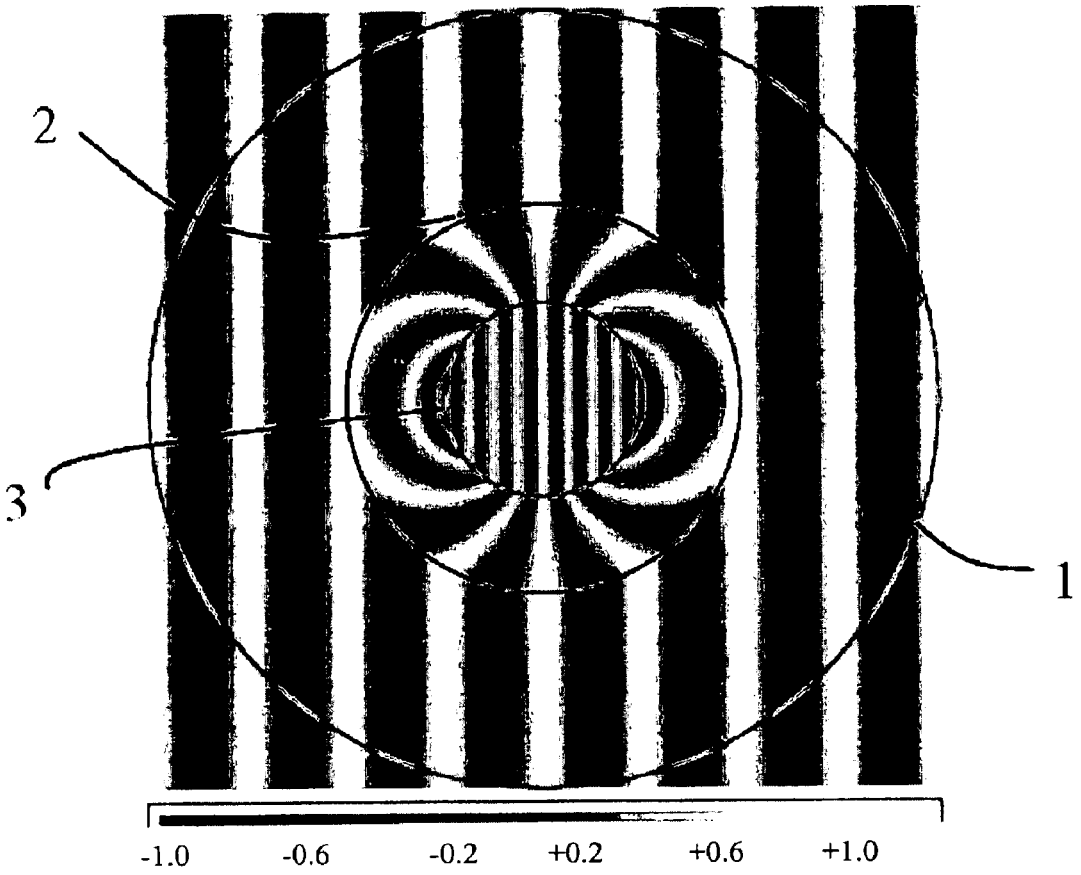
FIG. 18 is a magnetic field diagram of a perfect system.
Figure 19A:
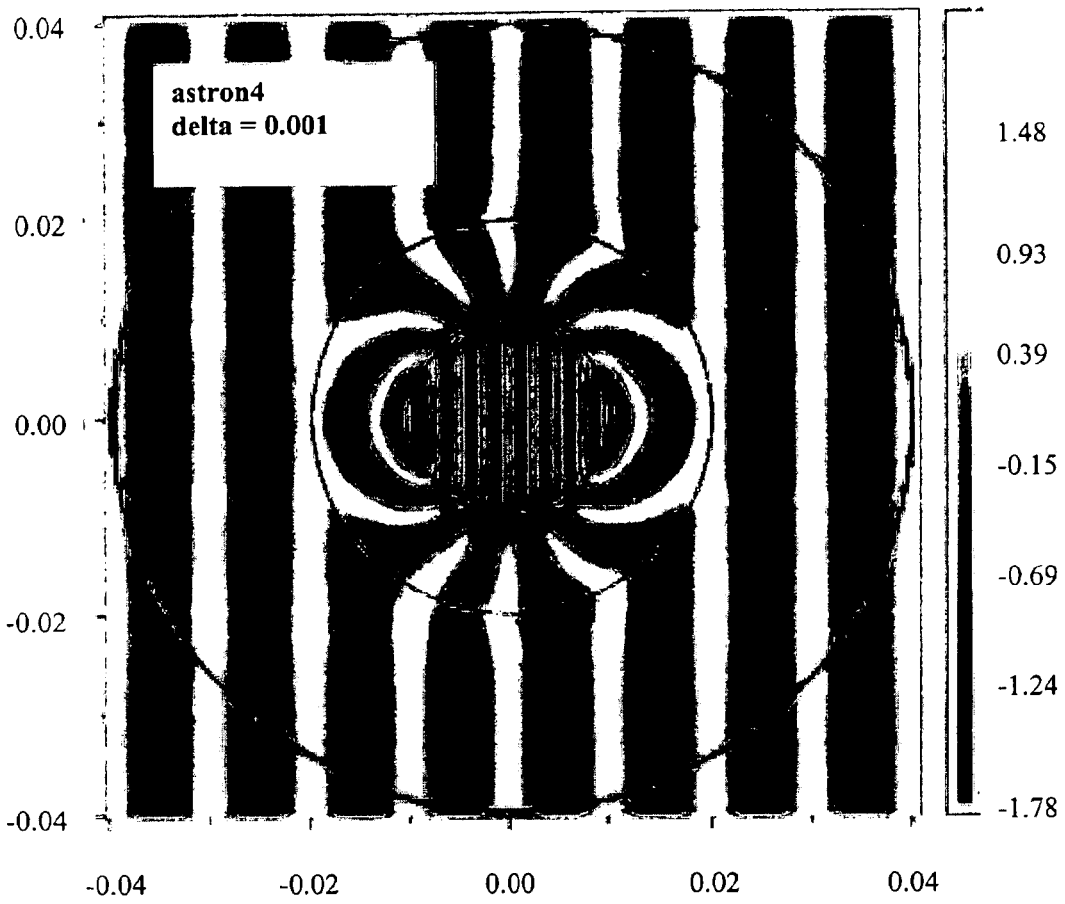
FIGS. 19*a* through 19*f* illustrate the magnetic field for increasing levels of loss δ.
Figure 19B:
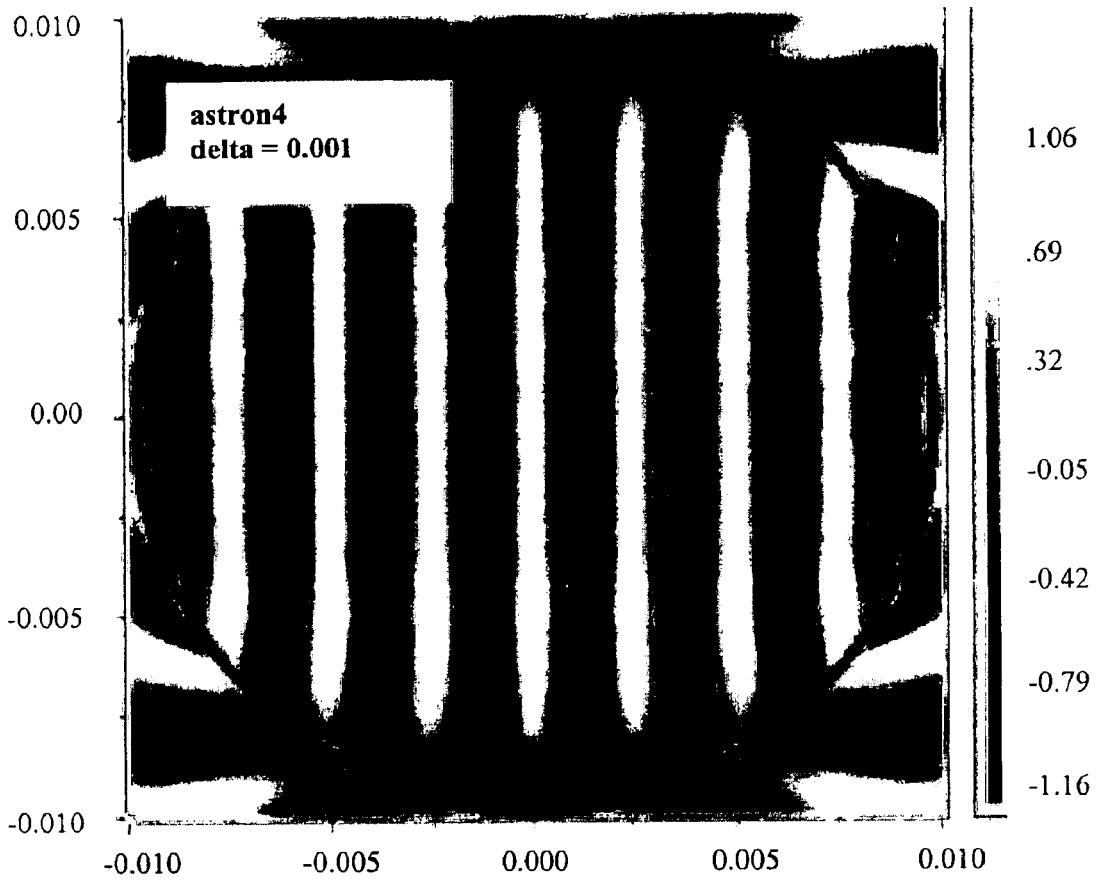
Figure 19C:
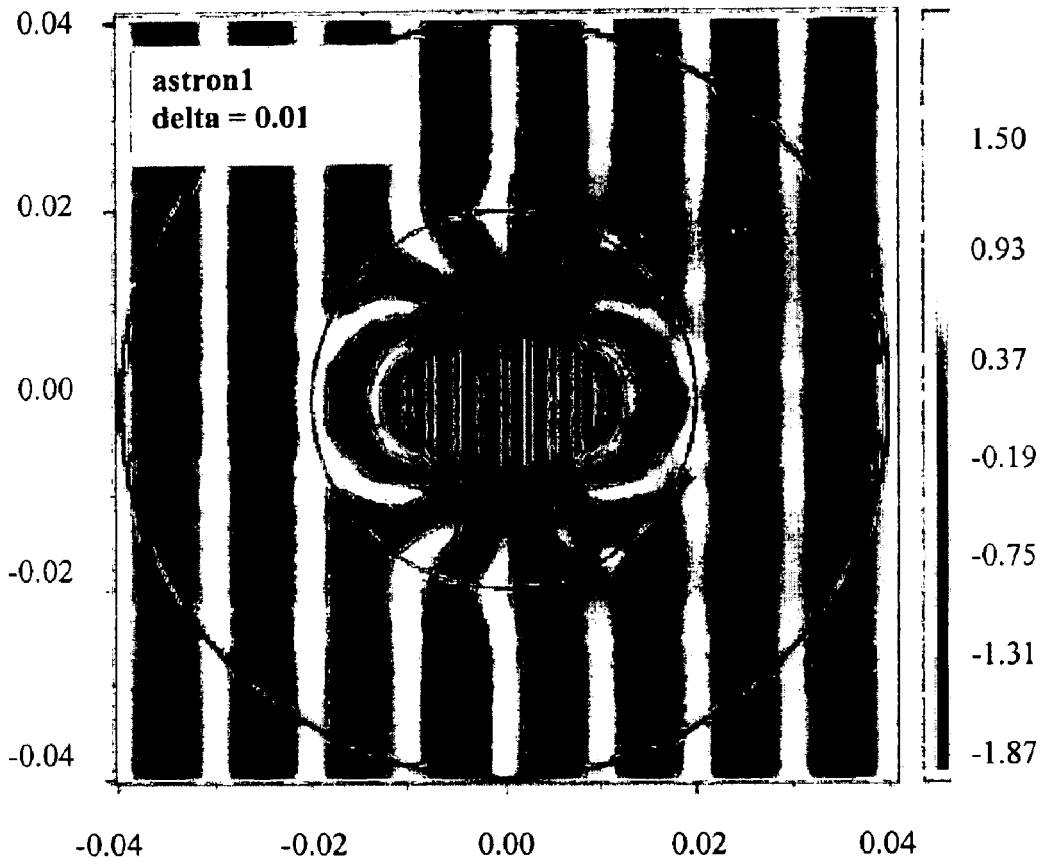
Figure 19D:
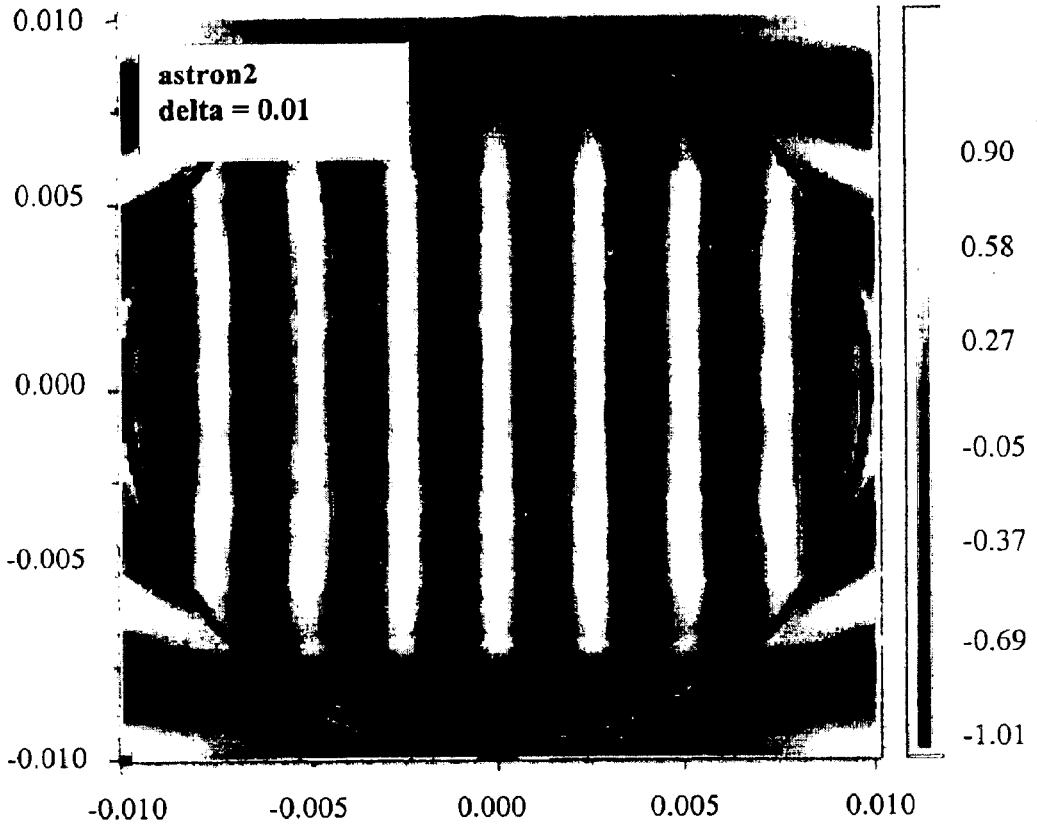
Figure 19E:
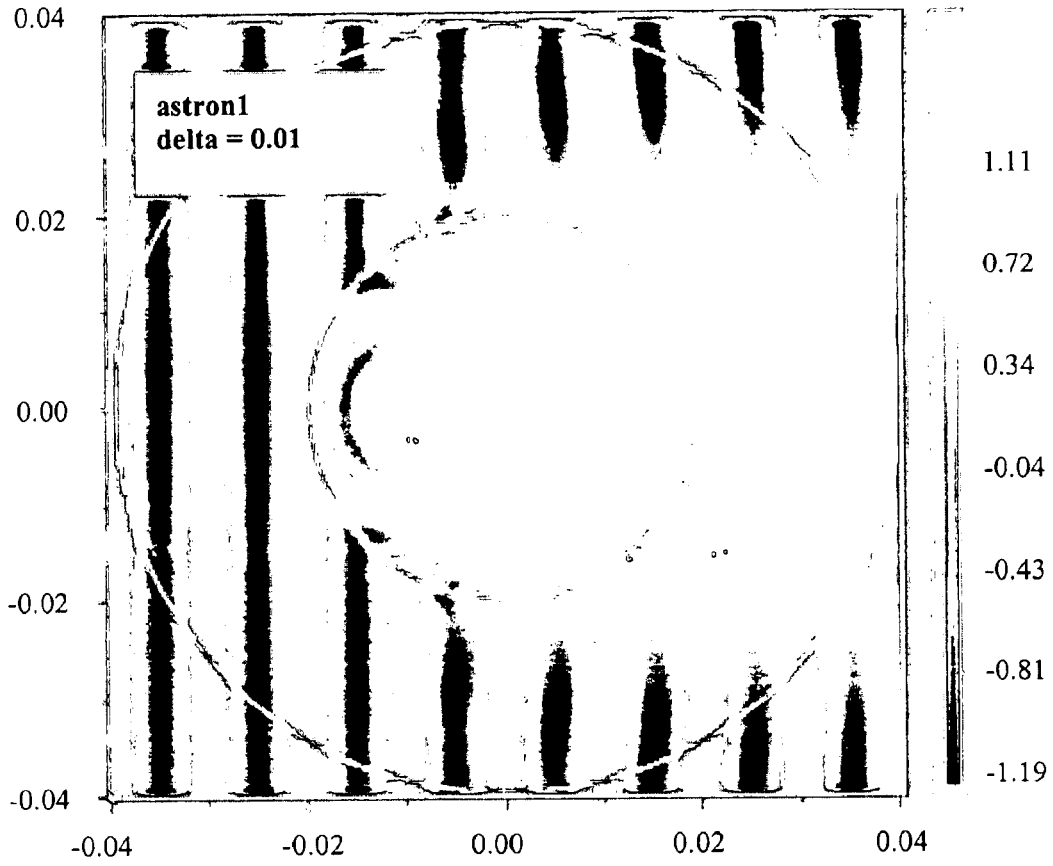
Figure 19F:
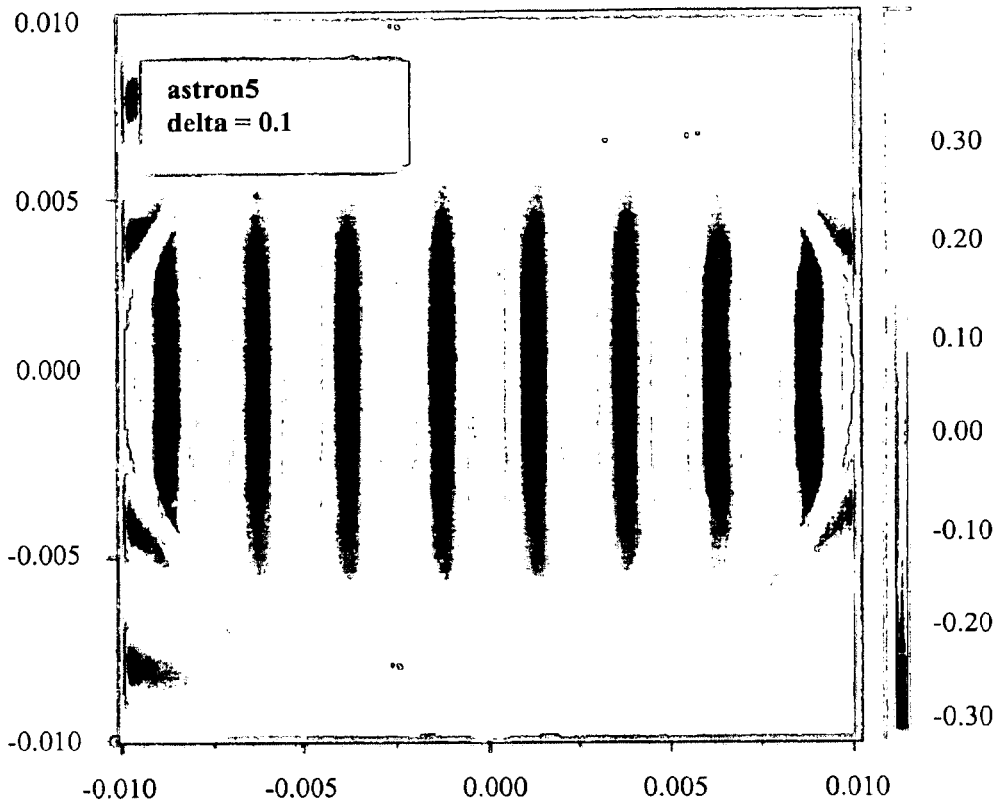

There are several points of interest in FIG. 18. Note that the fields are uniform everywhere, with excursions only between ±1. Contrast FIG. 18 (the full solutions of Maxwell's equations) with the ray diagram in FIG. 17. The ray picture predicts a region of "closed orbits" 72 inaccessible to the outside world. However there is no evidence of these empty regions in FIG. 18: the wave nature of light has ensured that these regions are equally populated, at least in an ideal system. In this system the ray vectors representing the group velocity and Poynting vector are orthogonal to the phase fronts, as can be verified by comparing the two figures and remembering that in a negative medium the phase and group velocities are oppositely directed.

The solution to Maxwell's equations in (52), (53), and (56), assumes that the values prescribed for $\epsilon,\mu$ can be realized exactly. In the next section we examine how the situation degrades when there is less than perfect realization of $\epsilon,\mu$ and the effects of losses which degrade the resonances which populate the inner cylinder 3 with flux. To calculate the less than perfect fields we need to make a more formal decomposition of the fields in terms of cylindrical harmonics:

We assume that region I, $r>r_2$, comprises free space so that, $$\begin{aligned} H_z^I &= H_z^{inc}\exp(ik_1r\cos\varphi-i\omega t)+H_z^{scatt}\exp(ik_1'r\cos\varphi'-i\omega t) \\ &= H_{z0}\sum_{m=-\infty}^{m=+\infty}[J_m(k_1r)+a_mH_m^{(1)}(k_1r)]i^m\exp(im\varphi-i\omega t),\ r>r_2 \end{aligned} \tag{57}$$

where, $$k_1=\omega c_0^{-1} \tag{58}$$

and $J_m$,$H_m^{(I)}$ and cylindrical Bessel functions of order m. In the absence of any material inside the cylinder, there would of course be no scattered wave and $a_m=0$. There would also be no scattered wave if the inner region 2, 3 was filled precisely as prescribed above, but since we are now considering an imperfect situation, we need to allow for scattering.

In region II, $r_3<r<r_2$, we no longer have an ideal material and therefore writing the solutions of Maxwell's equations is more involved. We shall assume that the imperfections arise from the materials employed being lossy, and for simplicity we shall further assume that the loss takes a particular form:

$$\begin{aligned} \mu(r)&=(1+i\delta)\mu_{ideal}(r),\ r_3<r_2 \\ \epsilon(r)&=(1+i\delta)\epsilon_{ideal}(r),\ r_3<r_2 \end{aligned} \tag{59}$$

With this assumption we can exploit coordinate transformation to write down the solutions in this region:

$$H_z^{II}=H_{z0}\sum_{m=-\infty}^{m=+\infty}[b_mJ_m(k_2[r_2^2/r])+c_mY_m(k_2[r_2^2/r])]i^m\exp(im\varphi-i\omega t),\quad r_3<r<r_2 \tag{60}$$

where $J_m(k_2r)$,$Y_m(k_2r)$ solve Maxwell's equations in a uniform medium with gain, so that, $$k_2=(1-i\delta)\omega c_0^{-1} \tag{61}$$

which transforms to absorption when inverted in the complementary medium.

Region III, $r_3>r$, we assume that we can make this essentially free of loss since it is a "normal" non negative medium.

$$H_z^{III}=H_{z0}\sum_{m=-\infty}^{m=+\infty}d_mJ_m(k_3r)i^m\exp(im\varphi-i\omega t),\ r_3>r \tag{62}$$

where, $$k_3=\omega c_0^{-1}r_1/r_3=k_1r_1/r_3 \tag{63}$$

These assumptions, made to represent imperfections in the simplest realistic manner, will not affect the qualitative nature of our conclusions.

It remains to calculate the coefficients, which we do in the appendix with the following results:

First we define $A_m$,$B_m$,$C_m$, $$A_m=-\frac{J_m(k_2[r_2^2/r_3])J_m'(k_3r_3)+\frac{k_2r_2^2}{k_3r_3^2\varepsilon_\varphi}J_m(k_3r_3)J_m'(k_2[r_2^2/r_3])}{Y_m(k_2[r_2^2/r_3])J_m'(k_3r_3)+\frac{k_2r_2^2}{k_3r_3^2\varepsilon_\varphi}J_m(k_3r_3)Y_m'(k_2[r_2^2/r_3])} \tag{64}$$

$$B_m=\frac{J_m(k_1r_2)H_m^{(1)\prime}(k_1r_2)-H_m^{(1)}(k_1r_2)J_m'(k_1r_2)}{Y_m(k_2r_2)H_m^{(1)\prime}(k_1r_2)+\frac{k_2}{k_1\varepsilon_\varphi}H_m^{(1)}(k_1r_2)Y_m'(k_2r_2)} \tag{65}$$

$$C_m=\frac{J_m(k_2r_2)H_m^{(1)\prime}(k_1r_2)+\frac{k_2}{k_1\varepsilon_\varphi}H_m^{(1)}(k_1r_2)J_m'(k_2r_2)}{Y_m(k_2r_2)H_m^{(1)\prime}(k_1r_2)+\frac{k_2}{k_1\varepsilon_\varphi}H_m^{(1)}(k_1r_2)Y_m'(k_2r_2)} \tag{66}$$

which we then use to calculate the coefficients required:

$$b_m=\frac{B_m}{A_m-C_m},\quad c_m=\frac{A_mB_m}{A_m-C_m} \tag{67}$$

$$a_m=\frac{b_mJ_m(k_2r_2)+c_mY_m(k_2r_2)-J_m(k_1r_2)}{H_m^{(1)}(k_1r_2)} \tag{68}$$

$$d_m=\frac{b_mJ_m(k_2[r_2^2/r_3])+c_mY_m(k_2[r_2^2/r_3])}{J_m(k_3r_3)} \tag{69}$$

We now have the solutions we require.

Discussion of the Materials Required

Let us recap on our objectives. The aim is to achieve angular resolution which beats the diffraction limit. The material part of the system is contained within $r<r_2$ and the resolution we could obtain from a conventional system of these dimensions is of the order, $$\Delta\theta_2=\lambda/(2r_2) \tag{70}$$

The fields have been decomposed into cylindrical waves of order m: see equation (57) which we reproduce here, $$H_z^I = H_{z0}\sum_{m=-\infty}^{m=+\infty}[J_m(k_1r)+a_mH_m^{(1)}(k_1r)]i^m\exp(im\varphi-i\omega t),\ r>r_2 \tag{57}$$

Clearly the higher values of m contribute greatest to the angular resolution and we can give an equivalent formula for the resolution, $$\Delta\theta=\pi/m_{max} \tag{71}$$

which from (70) implies that on the boundary $r=r_2$, $$m_{max2}=2\pi r_2/\lambda=k_1r_2 \tag{72}$$

and, $$J_m(k_1r_2)\approx 0,\ m>k_1r_2 \tag{73}$$

This is a point made at the beginning in equation (3).

Inside the inner cylinder 3 the fields are give by (62), $$H_z^{III} = H_{z0}\sum_{m=-\infty}^{m=+\infty}d_mJ_m(k_3r)i^m\exp(im\varphi-i\omega t),\ r_3>r \tag{62}$$

This cylinder is filled with a high refractive index material so that, $$n_3=r_1/r_3 \tag{74}$$

so that, $$k_3=k_1r_1/r_3 \tag{75}$$

and in principle this small cylinder 3 has, $$m_{max3}=k_3r_3=k_1r_1 \tag{76}$$

In other words within this small high refractive index cylinder 3 we have the potential for angular resolution equal to that provided by a much larger cylinder radius $r_1$ in free space. This is only true if we can ensure that the relevant waves actually get through, $$d_m\approx 1,\ m<m_{max3} \tag{77}$$

Our ideal design ensures that $d_m=1$ for all values of m but losses will degrade this ideal performance and hence degrade the resolution.

First we discuss the classical ray picture. Absorption will reduce the intensity of a ray but unless the absorption is very large it will not have a catastrophic impact on the ability of a ray to reach the interior of the inner cylinder 3. Therefore we expect the rays mainly to get through. However as we have seen in (72) $m_{max2}$ gives only the angular resolution associated with $r_2$, not the enhanced resolution associated with $r_1$.

The additional waves with higher values of m can only enter the inner cylinder 3 by tunneling through the resonances corresponding to the closed classical ray trajectories. Unfortunately resonances are very susceptible to absorption and we expect that for even modest values of loss δ the resonances may be sufficiently damped to cut the angular resolution back to the smaller value. Very low loss materials will be needed to realize the full performance of the system.

With that introduction let us see what the calculations give. We choose a system with dimensions appropriate to the GHz regime, $$r_1=0.04\text{m},\quad r_2=0.02\text{m},\quad r_3=0.01\text{m},\quad f=\omega/(2\pi)=30\ \text{GHz} \tag{78}$$

Thus our ideal resolution would be, $$\Delta\theta_1=\lambda/(2r_1)=0.01/(2\times 0.4)=0.125\ \text{radians}=7.16\ \text{degrees} \tag{79}$$

whereas simply filling the space inside $r_2$ with conventional technology would give only half that resolution, $$\Delta\theta_2=\lambda/(2r_2)=0.01/(2\times 0.02)=0.25\ \text{radians}=14.32\ \text{degrees} \tag{80}$$

We could be more ambitious choosing a larger ratio $r_2/r_3$, but this places greater demands on the material.

We made three sets of calculations corresponding to, $$\delta=0.1,\quad 0.01,\quad 0.001, \tag{81}$$

Roughly speaking the larger values of loss are easily attained with current technology, whereas δ=0.01 will be a challenge.

We assume a plane wave incident along the x-axis with magnetic field polarized along the z-axis. In FIG. 19 we show the real part of $H_z$. FIG. 16 shows three separate calculations of $H_z$ for a system containing a negatively refracting material in the middle cylinder 2, and a high refractive index material inside the inner cylinder 3. On the left is an overview showing all three cylinders. To the right an expanded scale showing just the inner cylinder 3. The top pair is calculated for low losses, δ=0.001, the next pair for δ=0.01, and the bottom pair for δ=0.1. Note how as the loss is increased the fields are confined to the region occupied by the rays in FIG. 17.

Comparing FIGS. 18 and 19 the calculations show that the very lowest losses of δ=0.001 give results comparable to the exact calculation. These low losses are probably not yet attainable with current technology. Higher losses, δ=0.01, show the field losing its strength at the top and bottom of the green cylinder where the ray trajectories would be closed, see FIG. 17. As predicted these regions require resonant interactions before the field can penetrate which are vulnerable to losses. Finally for δ=0.1 we see considerable departures from the ideal fields. Inside the inner cylinder 3 the fields are more or less confined to the open ray trajectories. Outside the outer cylinder 2 there is evidence of strong forward scattering from the system, and overall the field intensity is much reduced even where the rays penetrate. Our qualitative conclusion from FIG. 19 is that losses of the order of δ=0.01 or less are desirable.

Figure 20:
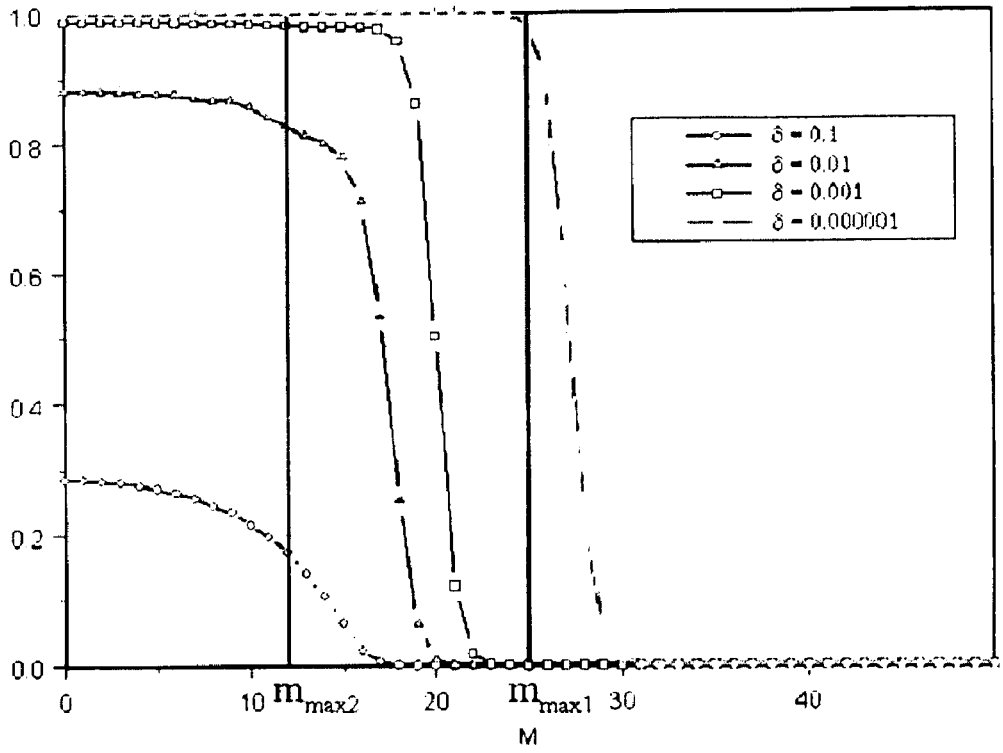
FIG. 20 illustrates the amplitude $d_m$ of the mth order of the wave field inside the smallest cylinder of an antenna as shown in FIG. 3.

FIG. 20 shows the amplitude $d_m$ of the mth order component of the wave field inside the smallest cylinder 3 (see equation (62)) for various levels of loss as measured by δ. The more non zero values of $d_m$ the better the angular resolution. The vertical line to the right shows the number of non zero values we are aiming for and would give the maximum resolution, the vertical line to the left shows what conventional technology would give by exploiting the space inside $r_2$.

To estimate the angular resolution we can expect in each case we show in FIG. 20 the cylindrical wave amplitudes within the smallest cylinder 3, $d_m$, see equation (62). The maximum non zero value dictates the angular resolution.

The vertical marker to the right shows $m_{max1}$, the ideal we are aiming for. The extremely low loss calculation, $\delta=0.000001$, comfortably exceeds this target, but with this set up the resolution is in any case limited by $m_{max1}$. The marker to the left shows $m_{max2}$ which is attainable by conventional technology. Therefore a cut off in $d_m$ above $m_{max2}$ means that an improvement in the diffraction limit has been achieved.

The high loss material shows no improvement over conventional technology. Intermediate losses of $\delta=0.01$ give useful improvement from $\Delta\theta_2=14.32°$ to around $\Delta\theta=11°$, low loss of $\delta=0.001$ gives $\Delta\theta=9°$, approaching the ideal of $\Delta\theta=7°$.

Figure 21:
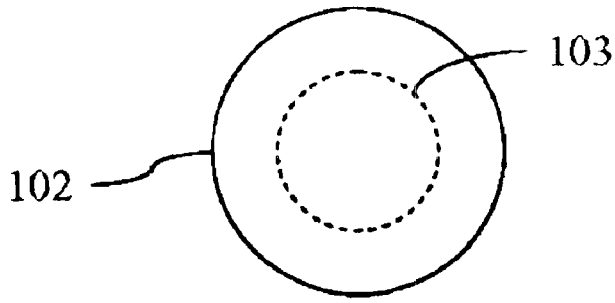
FIG. 21 schematically illustrates an antenna having an inner sphere of a first refractive index which is substantially enclosed within an outer sphere of a negative refractive index.

Reference, has been made above to an antenna of a generally cylindrical form. However, the antenna may be provided in any suitable form. For instance the antenna may comprise, as illustrated in FIG. 21, an inner sphere 103 of a first refractive index substantially enclosed within an outer sphere 102 of a negative refractive index. Other geometrical forms are envisaged and the above description relating to a cylindrical form is not intended to be limiting on the implementation of an antenna as taught.

The spherical equivalence of equations (34) and (35) are as follows:

$$\varepsilon_x = \varepsilon_y = \varepsilon_z = +\frac{r_2^2}{r_3^2}, \quad 0 < r < r_3 \tag{82}$$

$$\varepsilon_x = \varepsilon_y = \varepsilon_z = -\frac{r_2^2}{r^2}, \quad r_3 < r < r_2$$

$$\epsilon_x=\epsilon_y=\epsilon_z=+1, \; r_2<r<\infty$$

$$\mu_x=\epsilon_x, \; \mu_y=\epsilon_y, \; \mu_z=\epsilon_z \tag{83}$$

Thus there is provided an antenna which beats the diffraction limit for the angular sensitivity of an aerial of a given aperture. The device exploits negatively refracting materials to enhance the angular resolution. In an ideal situation infinite improvement is in principle possible. A test calculation which aims to improve resolution by a factor of two, and assumes that ideal materials were available, shows that the design is a successful one. Consideration of losses which are likely to occur in real materials reduces this improvement but for a material having a level of losses which we believe may be attainable in the near future resolution could be substantially enhanced relative to the conventional limit. The materials challenge is severe, but when low loss negative materials become readily commercially available, the diffraction limit on angular resolution may be beaten effectively.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. An antenna comprising:

a first region having a first refractive index; and a second region having a negative refractive index, said second region substantially surrounding said first region, such that radiation outside said second region is reproduced in said first region.

2. An antenna as defined in claim 1, wherein said first region has a positive refractive index.

3. An antenna as defined in claim 1, wherein the refractive index of said second region effectively cancels out the optical properties of said first region.

4. An antenna as, defined in claim 1, wherein said first region comprises:

a first cylinder; and wherein said second region comprises:

a second cylinder substantially surrounding said first cylinder.

5. An antenna as defined in claim 4, wherein the length of said first cylinder and said second cylinder is relatively long compared with the wavelength of radiation to be reproduced in said first region.

6. An antenna as defined in claim 4, wherein said first cylinder has a radius of $r_3$ and wherein said second cylinder has a radius of $r_2$, and wherein the refractive index n of said first cylinder is $n=r_2^2/r_3^2$.

7. An antenna as defined in claim 4, wherein said first cylinder has a radius of $r_3$ and said second cylinder has a radius of $r_2$, and wherein the electrical permittivity $\epsilon$ of said first and second cylinders are as follows:

$$\epsilon_x=+1, \; \epsilon_y=+1, \; \epsilon_z=+1, \; r>r_2$$

$$\epsilon_x=-1, \; \epsilon_y=-1, \; \epsilon_z=-r_2^4/r^4, \; r_3<r<r_2$$

$$\epsilon_x=+1, \; \epsilon_y=+1, \; \epsilon_z=+r_2^4/r_3^4=+r_1^2/r_3^2, \; r<r_3$$

the magnetic permeability $\mu$ being equal to the electrical permittivity $\epsilon$.

8. An antenna as defined in claim 4, wherein said first cylinder has a radius of $r_3$ and said second cylinder has a radius of $r_2$, and wherein said antenna reproduces radiation in an area of radius $r_1$ outside said second cylinder, where $r_1>r_2$, wherein $$\frac{r_2^2}{r_3} = r_1.$$

9. An antenna as defined in claim 1, wherein said first region comprises:

a sphere; and wherein said second region comprises:

a second sphere substantially enclosing said first sphere.

10. An antenna as defined in claim 9, wherein said first sphere has a radius of $r_3$ and wherein said second sphere has a radius of $r_2$, and wherein the electrical permittivity $\epsilon$ of said first and second spheres are as follows:

$$\varepsilon_x = \varepsilon_y = \varepsilon_z = +\frac{r_2^2}{r_3^2}, \quad 0 < r < r_3$$

-continued $$\varepsilon_x = \varepsilon_y = \varepsilon_z = -\frac{r_2^2}{r^2}, \quad r_3 < r < r_2$$

and the magnetic permeability $\mu$ is equal to the electrical permittivity $\epsilon$.

11. An antenna as defined in claim 1, wherein said antenna comprises a narrow beam antenna.

12. A method of producing an antenna comprising:

providing a first region having a first refractive index; and providing a second region having a negative refractive index, said second region substantially surrounding said first region, such that radiation outside said second region is reproduced in said first region.

13. A method as defined in claim 12, wherein said first region has a positive refractive index.

14. A method as defined in claim 12, wherein the refractive index of said second region effectively cancels out the optical properties of said first region.

15. A method as defined in claim 12, wherein said providing said first region step comprises:

providing a first cylinder; and wherein said providing said second region step comprises:

providing a second cylinder substantially surrounding said first cylinder.

16. A method as defined in claim 12, wherein said providing said first region step comprises:

providing a sphere; and and wherein said providing said second region step comprises:

providing a second sphere substantially enclosing said first sphere.

17. A method as defined in claim 12, wherein said antenna comprises a narrow beam antenna.

18. A narrow beam antenna comprising:

a first region having a first refractive index which is positive; and a second region having a negative refractive index, said second region substantially surrounding said first region, such that radiation outside said second region is reproduced in said first region, wherein the refractive index of said second region effectively cancels out the optical properties of said first region.

19. A method as defined in claim 18, wherein said first region comprises:

a first cylinder; and wherein said second region comprises:

a second cylinder substantially surrounding said first cylinder.

20. A method as defined in claim 18, wherein said first region comprises:

a sphere; and wherein said second region comprises:

a second sphere substantially enclosing said first sphere.

* * * * *